US005358463A

United States Patent [19]

Fuentes

[11] Patent Number: 5,358,463

[45] Date of Patent: Oct. 25, 1994

[54] EXERCISE DEVICE

[76] Inventor: Jesus Fuentes, 12 South Rd., Central Islip, N.Y. 11722

[21] Appl. No.: 952,595

[22] Filed: Sep. 28, 1992

[51] Int. Cl.[5] ..... A63B 26/00

[52] U.S. Cl. ..... 482/141; 482/44; 482/147

[58] Field of Search ..... 482/44–46, 482/49, 141, 146, 147

[56] References Cited

U.S. PATENT DOCUMENTS

| | | | |
|---|---|---|---|
| 3,115,338 | 12/1963 | Acs et al. | 482/141 |
| 3,730,521 | 5/1973 | Sellman | 482/147 |
| 4,351,525 | 9/1982 | Rozenblad | 482/141 |
| 4,585,228 | 4/1986 | Olson | 482/44 |
| 4,768,778 | 9/1988 | Thomas, Jr. | 482/44 |
| 5,073,144 | 12/1991 | Stenglein | 384/44 |

*Primary Examiner*—Richard J. Apley
*Assistant Examiner*—Jeanne M. Mollo

[57] ABSTRACT

An improved exercise device is provided which consists of a hand engaging member, a base for supporting the hand engaging member on an underlying surface and a mechanism for rotating the hand engaging member about a vertical axis relative to the base, so that a user can develop a forearm/arm and upper body, while doing push-ups, so as to better execute karate punches and other sport motions of a like nature.

7 Claims, 2 Drawing Sheets

EXERCISE DEVICE

BACKGROUND OF THE INVENTION

1. Field of the Invention

The instant invention relates generally to exercise apparatuses and more specifically it relates to an improved exercise device.

2. Description of the Prior Art

Numerous exercise apparatuses have been provided in prior art that are adapted to perform various types of body exercises such as push-ups and the like. While these units may be suitable for the particular purpose to which they address, they would not be as suitable for the purposes of the present invention as heretofore described.

SUMMARY OF THE INVENTION

A primary object of the present invention is to provide an improved exercise device that will overcome the shortcomings of the prior art devices.

Another object is to provide an improved exercise device having a hand engaging member which is rotatable about a vertical axis, so that the forearm/arm and upper body of the user engaging the device can be developed while doing push-ups, so as to better execute karate punches and other sport motions of a like nature.

An additional object is to provide an improved exercise device in which the hand engaging member can be either a to support a clenched fist or a handle for a hand to grasp when the user is doing the push-ups.

A further object is to provide an improved exercise device that is simple and easy to use.

A still further object is to provide an improved exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 5:
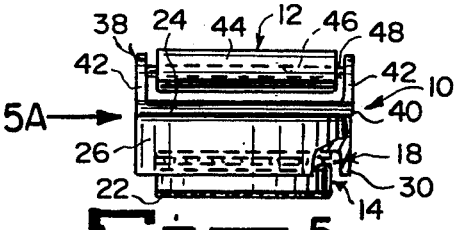
FIG. 5 is a front elevational view with parts broken away of a second embodiment of the instant invention.

Turning now descriptively to the drawings, in which similar reference characters denote similar elements throughout the several views, the Figures illustrate an improved exercise device 10 which consists of a hand engaging member 12, a base 14 for supporting the hand engaging member 12 on an underlying surface 16 and a mechanism 18 for rotating said hand engaging member 12 about a vertical axis relative to the base 14, so that a user can develop a forearm/arm 20 and upper body, while doing push-ups, so as to better execute karate punches and other sport motions of a like nature.

A non-slip pad 22 is affixed to the underside of the base 14 to grip the underlying surface 16 upon which it rests. The non-slip pad 22 is fabricated from a high friction material, typically but not limited to rubber, plastic and the like. The non-slip pad 22 is affixed to the underside of the base 14 by adhesive material 24.

Figure 3:
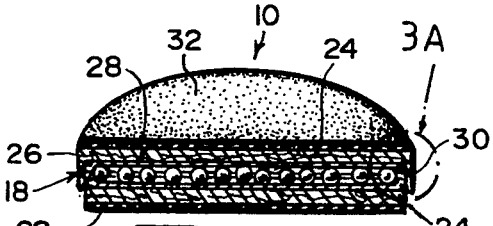
FIG. 3 is a top perspective cross sectional view taken along line 3—3 in FIG. 2.
Figure 4:
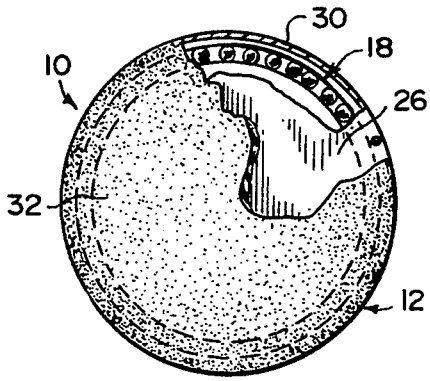
FIG. 4 is a top view with parts broken away taken in direction of arrow 4 in FIG. 2.
Figure 3A:
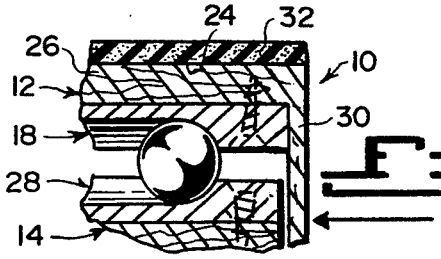
FIG. 3A is an enlarged cross sectional view of the area indicated by arrow 3A in FIG. 3.
Figure 6:
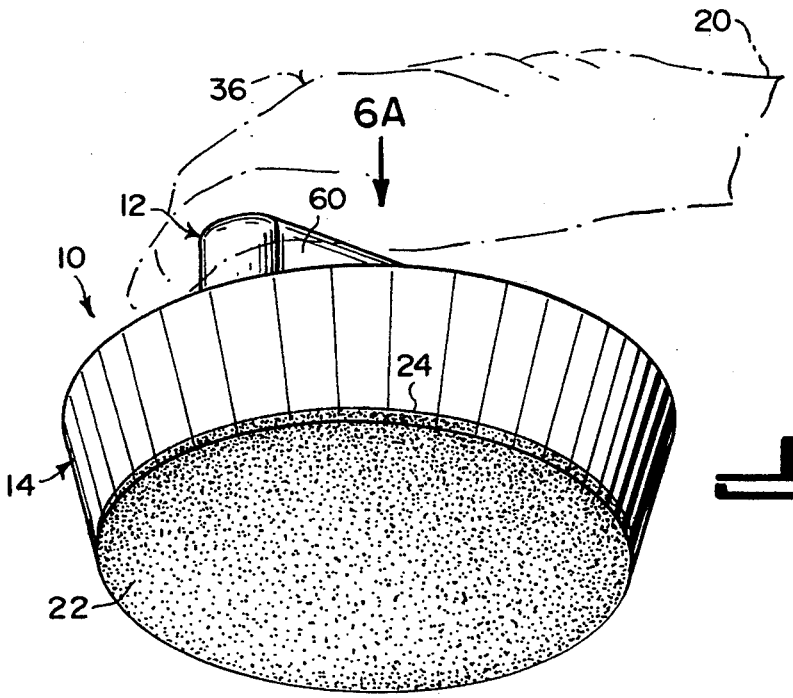
FIG. 6 is a bottom perspective view of a third embodiment of the instant invention.
Figure 6A:
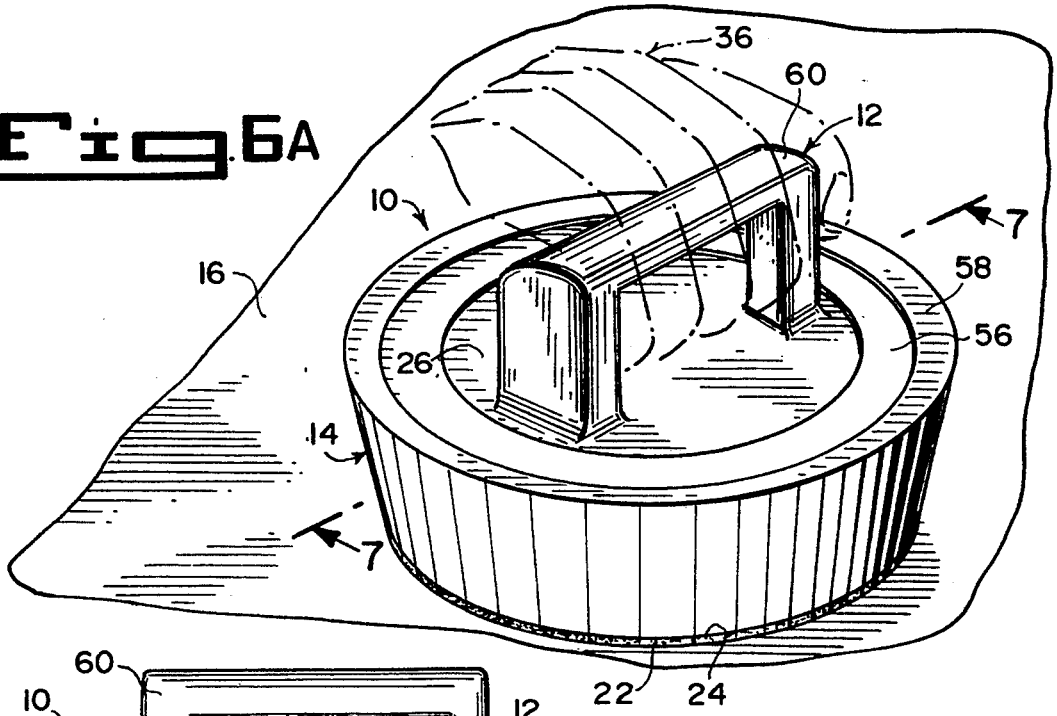
FIG. 6A is a top perspective view taken in direction of arrow 6A in FIG. 6.

The hand engaging member 12 includes a body 26 to sit upon the rotating mechanism 18. The rotating mechanism 18, as best seen in FIGS. 3 and 3A, is a ball bearing 28 positioned between the body 26 and the base 14. The base 14 in FIGS. 1 through 5A is cylindrical, the non-slip pad 24 is circular, the body 26 is cylindrical and the ball bearing 28 is circular. The cylindrical body 26 includes an annular downwardly extending flange 30, which is sized to fit about the circular ball bearing 28 and a portion of the cylindrical base 14.

The hand engaging member 12, shown in FIGS. 1 through 4, further includes a circular contact pad 32 affixed to the top surface of the cylindrical body 26 to support a clenched fist 34 of the hand 36 of the user. The circular contact pad 32 can be fabricated from a relatively soft deformable material, typically but not limited to foam rubber, foam plastic and the like. The circular contact pad 32 is affixed to the top side of the cylindrical body 26 by adhesive material 24.

Figure 5A:
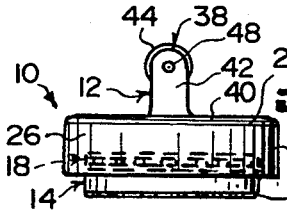
FIG. 5A is a side view taken in direction of arrow 5A in FIG. 5.
Figure 1:
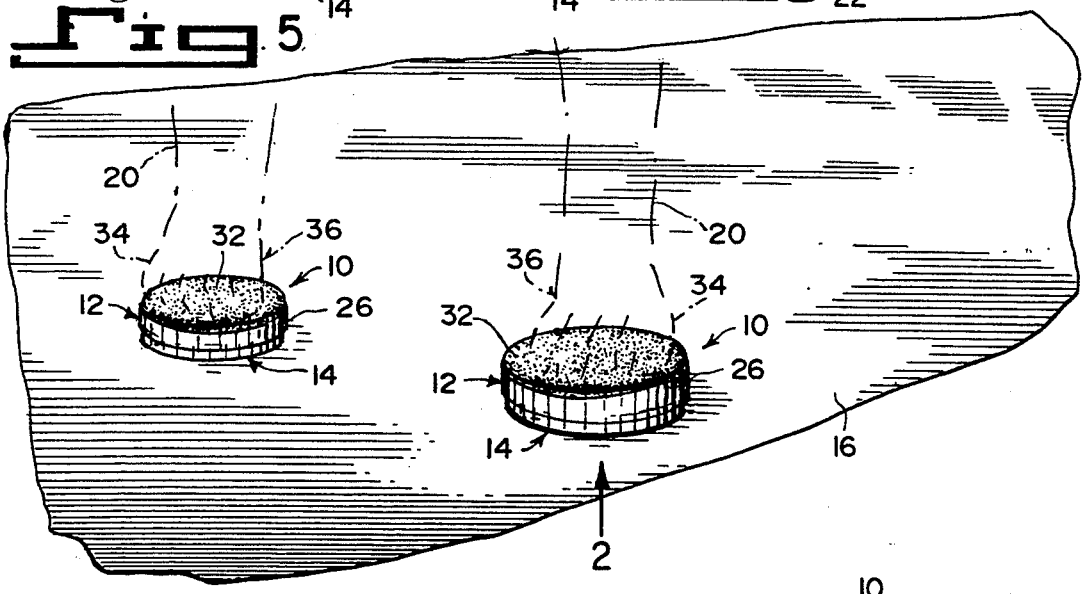
FIG. 1 is a top perspective view showing two of the first embodiments of the instant invention being used.
Figure 2:
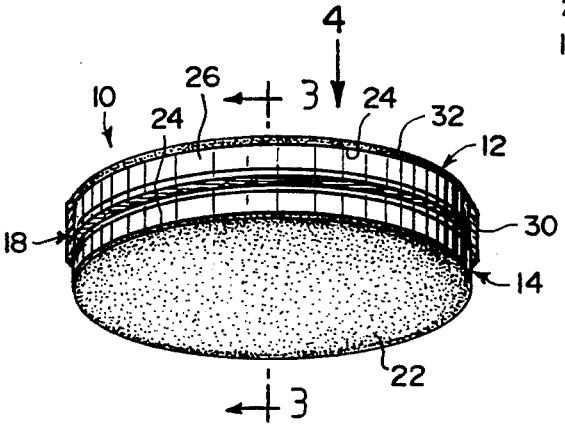
FIG. 2 is a bottom perspective view of the first embodiment taken in direction of arrow 2 in FIG. 1.

As shown in FIGS. 5 and 5A, the hand engaging member 12 further includes a U-shaped clevis 38 having a circular foot 40 and a pair of diametrical opposed ears 42 extending upwardly therefrom. The circular foot 40 is affixed to the top surface of the cylindrical body 26. A cylindrical handle 44 that is made out of a deformable material, has a central aperture 46 passing therethrough. A shaft 48 extends through the central aperture 46 in the cylindrical handle 44 to retain the cylindrical handle 44 to the ears 42, so that a hand 36 of the user can grasp the cylindrical handle 44 as tight as possible. The circular foot is affixed to the top side of the cylindrical body 26 by adhesive material 24.

Figure 7:
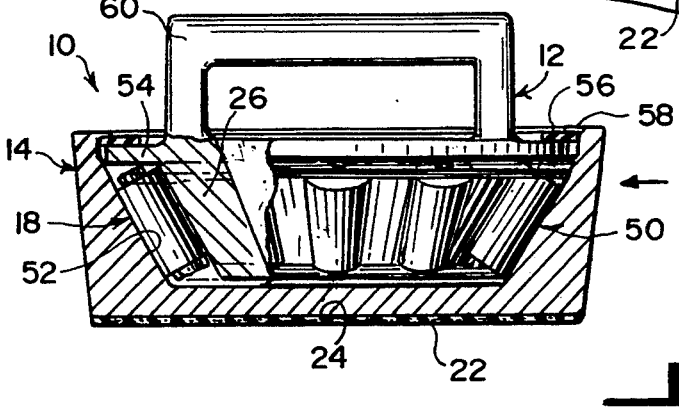
FIG. 7 is a partial cross sectional view with parts broken away taken along line 7—7 in FIG. 6A.
Figure 7A:
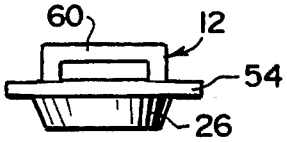
FIG. 7A is a front elevational view of just the handle with its respective housing used in the third embodiment.

As best seen in FIG. 7, the rotating mechanism 18 is a roller bearing assembly 50, which is positioned between the body 26 and the base 14. The base 14 is an inverted fustrum-shaped cone having a tapered compartment 52 therein, the non-slip pad 22 is circular, the body 26 is an inverted frustum-shaped cone and the roller bearing assembly 50 is tapered to fit into the tapered compartment 52 around the body 26.

The inverted fustrum-shaped cone body 26 contains an annular outwardly extending flange 54 which is sized to fit about the tapered roller bearing assembly 50, within the tapered compartment 52 of the base 14. A flat ring seal 56 fits between a top surface of the annular outwardly extending flange 54 and a top rim 58 of the tapered compartment 52 in the base 14.

The hand engaging member 12 further includes a C-shaped handle 60, which is affixed to the top surface of the body 26, so that a hand 36 of the user can grasp the C-shaped handle 60, while the forearm/arm 20 is in an aligned position with the hand 36 with the fingers and thumb bent about the C-shaped handle 20.

LIST OF REFERENCE NUMBERS

10: improved exercise device
12: hand engaging member
14: base
16: underlying surface
18: rotating mechanism
20: forearm/arm
22: non-slip pad
24: adhesive material
26: body
28: ball bearing for 18
30: annular downwardly extending flange on 26
32: circular contact pad
34: clenched fist
36: hand
38: U-shaped clevis
40: circular foot
42: ear
44: cylindrical handle
46: central aperture in 44
48: shaft
50: tapered roller bearing assembly for 18
52: tapered compartment in 14
54: annular outwardly extending flange on 26
56: flat ring seal
58: top rim of 52
60: C-shaped handle It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved exercise device for facilitating push-up exercises which comprises:

a pair of nonconnecting hand engaging members including a inverted frustum cone shaped body to sit upon a rotating means;

an inverted frustum cone shaped base for each said hand engaging member, having a tapered compartment therein, for supporting each said hand engaging member separately on an underlying surface;

a circular nonslip pad affixed to the underside of each said base to grip the underlying surface upon which the device rests, each of said non-slip pad is fabricated from a high friction material and is affixed to the underside of each of said base by an adhesive material;

said rotating means is a roller bearing assembly positioned between each said body and said base for rotating each said hand engaging member about a vertical axis relative to said base, each of said roller bearing assembly is tapered to fit into each of said tapered compartment about said body, and;

wherein said hand engaging members rotate relative to said bases so that a user can develop the forearm/arm and upper body, while doing modified push-ups, so as to better execute karate punches and other sport motions of a like nature.

2. An improved exercise device as recited in claim 1, wherein each of said inverted fustrum-shaped cone body includes an annular outwardly extending flange, which is sized to fit about said tapered roller bearing assembly within each said tapered compartment of said base.

3. An improved exercise device as recited in claim 2, further including a flat ring seal to fit between a top surface of said annular outwardly extending flange and a top rim of said tapered compartment in each of said base.

4. An improved exercise device as recited in claim 3, wherein each of said hand engaging member further includes a C-shaped handle affixed to the top surface of said body, so that a hand of the user can grasp said C-shaped handle, while the forearm/arm is in an aligned position with the hand with the fingers and thumb bent about said C-shaped handle.

5. An improved exercise device as recited in claim 4, wherein said circular contact pad protects a user's clenched fist.

6. An improved exercise device as recited in claim 5, wherein said inverted frustum-shaped cone body and an said annular outwardly extending flange are homogeneous.

7. An improved exercise device as recited in claim 6, wherein said flat ring seal is resilient.

* * * * *